United States Patent [19]

Stroh et al.

[11] Patent Number: 4,840,336

[45] Date of Patent: Jun. 20, 1989

[54] CANTILEVERED SUPPORT ARMS FOR PLASTIC BAG RACK

[75] Inventors: Alvin L. Stroh, Downey; Terry C. Pilon, Claremont, both of Calif.

[73] Assignees: McMillin Wire & Plating, Inc., Los Angeles; Challenge Bag California, Inc., Rancho Cucamonga, both of Calif.

[21] Appl. No.: 202,329

[22] Filed: Jun. 6, 1988

[51] Int. Cl.[4] ..... B65B 67/04

[52] U.S. Cl. ..... 248/97; 248/175

[58] Field of Search ..... 248/95, 97, 98, 99, 248/100, 101, 121, 153, 175, 302; 220/1 T, 404

[56] References Cited

U.S. PATENT DOCUMENTS

| | | | |
|---|---|---|---|
| 447,686 | 3/1891 | Holladay | 248/97 |
| 2,078,866 | 4/1937 | Metz | 248/302 |
| 2,206,588 | 7/1940 | Tritt | 248/251 |
| 3,279,620 | 10/1966 | Nesbitt | 248/302 |
| 3,552,697 | 1/1971 | Pinto | 248/97 |
| 3,747,298 | 7/1973 | Lieberman | 248/100 |
| 4,332,361 | 6/1982 | McClellan | 248/95 |
| 4,458,867 | 7/1984 | Malik | 248/97 |
| 4,487,388 | 12/1984 | Provan . | |
| 4,498,652 | 2/1985 | Malik | 248/99 |
| 4,762,297 | 8/1988 | Milligan | 248/100 |

FOREIGN PATENT DOCUMENTS

| | | | |
|---|---|---|---|
| 262871 | 5/1964 | Netherlands | 248/100 |
| 155589 | 8/1956 | Sweden | 248/100 |

*Primary Examiner*—J. Franklin Foss
*Assistant Examiner*—Robert A. Olson
*Attorney, Agent, or Firm*—John T. Matlago

[57] ABSTRACT

A two-wire structure for use in suspending plastic bags on a rack is formed by inwardly bending each of the end portions of a single straight length of wire such that each lies against the middle portion thereof with their terminal ends butt welded together and with an upwardly directed looped protuberance formed on each end of the two-wire structure. Each end portion of the two-wire structure so formed is then bent to provide cantilevered support arms extending at right angles from each end of the middle portion thereof which forms the back of the two-wire structure by which the cantilevered support arms are attached to a rack. Such a construction provides the upwardly directed looped protuberances for use as safety precautions on the ends of the cantilevered support arms and further assures that each of the cantilevered support arms is provided with a continuous surface throughout its length. Such a continuous surface is needed to enable small mounting holes punched on the side handles of a stack of plastic bags in a flattened condition to pass over the end protuberances and slide along the cantilevered support arms during the storing and individual opening of the plastic bags in the stack.

8 Claims, 2 Drawing Sheets

CANTILEVERED SUPPORT ARMS FOR PLASTIC BAG RACK

BACKGROUND OF THE INVENTION

This invention relates to racks for plastic bags and more particularly to a cantilevered support arms apparatus for suspending plastic bags on a rack.

It is well known in the prior art to provide for use in a supermarket of a rack having a back wall with a pair of cantilevered support arms extending forwardly from each of the upper ends thereof. Such a pair of cantilevered support arms enables a stack of plastic bags having joined central tabs on the front and back walls thereof and opposing side handle portions with mounting holes punched thereon to be held on said rack by slipping the mounting holes over the respective free ends of the cantilevered support arms and moving the stack therealong to the back of the rack. Horizontal slits provided on the joined central tabs of the bags in the stack are then placed over a hook provided on the back of the rack. Such a setup enables the exposed wall of the front plastic flat bag of the stack to be grasped by the fingers and, upon being pulled forward, to be separated from the joined central tabs of the stack. This enables the opposing side handle portions on the front wall of the plastic bag to ride on their mounting holes along the cantilevered support arms while the back wall of the bag is still held on the stack by its central tab, thereby simply and effectively facilitating the opening of the bag for use by a checker.

It should now be clear that inasmuch as in the prior art each of the cantilevered support arms of the rack is a forwardly projecting wire or rod, if their ends are left exposed, the checker runs the risk of being poked by their relatively sharp points as she moves about during the filling of the plastic bags with articles. Accordingly, it has been the practice heretofore, to attach a flexible, plastic tube provided with a metal head, referred to as a feeler, as a safety precaution on the end of each of the arms. To attach the plastic tube, the diameter of the outer end portion of each of the wire support arms is reduced in diameter and the plastic tube is then forced thereover. The problem with attaching such a safety device on the end of each of the support arms is that because of the relatively rough treatment that the bag rack receives during the course of a day in a supermarket and the fact that plastic material deteriorates with age, these plastic tubes start to droop and eventually fall off the ends of the support arms. When this happens, the checker or box boy just continue to use the rack and bags with the reduced diameter ends of the cantilevered support arms exposed, thus risking even greater possibility of getting hurt if any part of their body happens to move thereagainst.

SUMMARY OF THE INVENTION

In accordance with the present invention an improved cantilevered support arms structure formed of a single length of wire is provided for use on a plastic bag rack. The structure is formed by bending each of the opposite end portions of the single length of wire back on its middle portion to form a two-wire structure with an upwardly directed looped protuberance on each of the free ends thereof and with the terminal ends of the single length of wire secured together. Each end portion of the two-wire structure is then bent to provide support arms cantilevered forwardly from each end of the middle portion thereof which forms the back by which the two-wire structure is attached to a rack.

This invention also includes a novel method of forming the pair of cantilevered support arms structure from a single length of wire. This method provides for initially bending each of the opposite free end portions of the single length of wire below its remaining middle portion with their opposing end terminals spaced from each other, and with each of the inwardly bent free end portions lying parallel to but spaced from the middle portion such that each of the ends of the two-wire structure assumes a U-shape. Upon these spaced end terminals being pulled together and butt welded, the previously parallel upper portion of the two-wire structure is necessarily caused to be bowed upwardly since it is longer in length than the lower portion resulting in the U-shaped ends of the two-wire structure now opening up with a wider angle. Now then when a press brake die is used to press down on the bowed upper portion of the two-wire structure, inward from each of the ends thereof, such that the bowed upper portion is now parallel and substantially in contact with the straight lower portion of the wire, the outer ends of the resulting two-wire structure are caused to assume the desired shape of upwardly directed looped protuberances. Each of the end portions of the two-wire structure so formed is then bent so as to be positioned at right angles to the middle back portion to provide the desired cantilevered support arms structure.

Accordingly, one of the objects of the present invention is to provide an improved cantilevered support arms structure for a plastic bag rack having upwardly directed looped protuberances integrally formed on the free ends thereof thereby making the rack safe for use by a checker.

Another object of the present invention is to provide a simple and inexpensive cantilevered support arms structure for a plastic bag rack having integrally formed on the free ends of each of the cantilevered support arms thereof upwardly directed loops protuberances which serve as safety precautions thereon that will last indefinitely.

Another object of the present invention is to provide upwardly directed looped protuberances for use as safety precautions on the ends of a pair of cantilevered support arms for a plastic bag rack while at the same time providing a continuous surface throughout the length of each cantilevered support arm including the upwardly directed looped protuberance on the end thereof.

Yet another object of the present invention is to provide a simple method for forming from a single length of wire an integrally formed upwardly directed looped protuberance on the outer end of each of the pair of cantilevered support arms being used for suspending plastic bags on a rack.

With these and other objects in view, the invention consists in the construction, arrangement and combination of the various parts of the device whereby the objects contemplated are attained as hereinafter set forth, pointed out in the appended claims and illustrated in the accompanying drawings.

DESCRIPTION OF THE PREFERRED EMBODIMENT

Figures 1, 2A, 2B, 2C, 2D, 2E, 2F, 4, 4A:
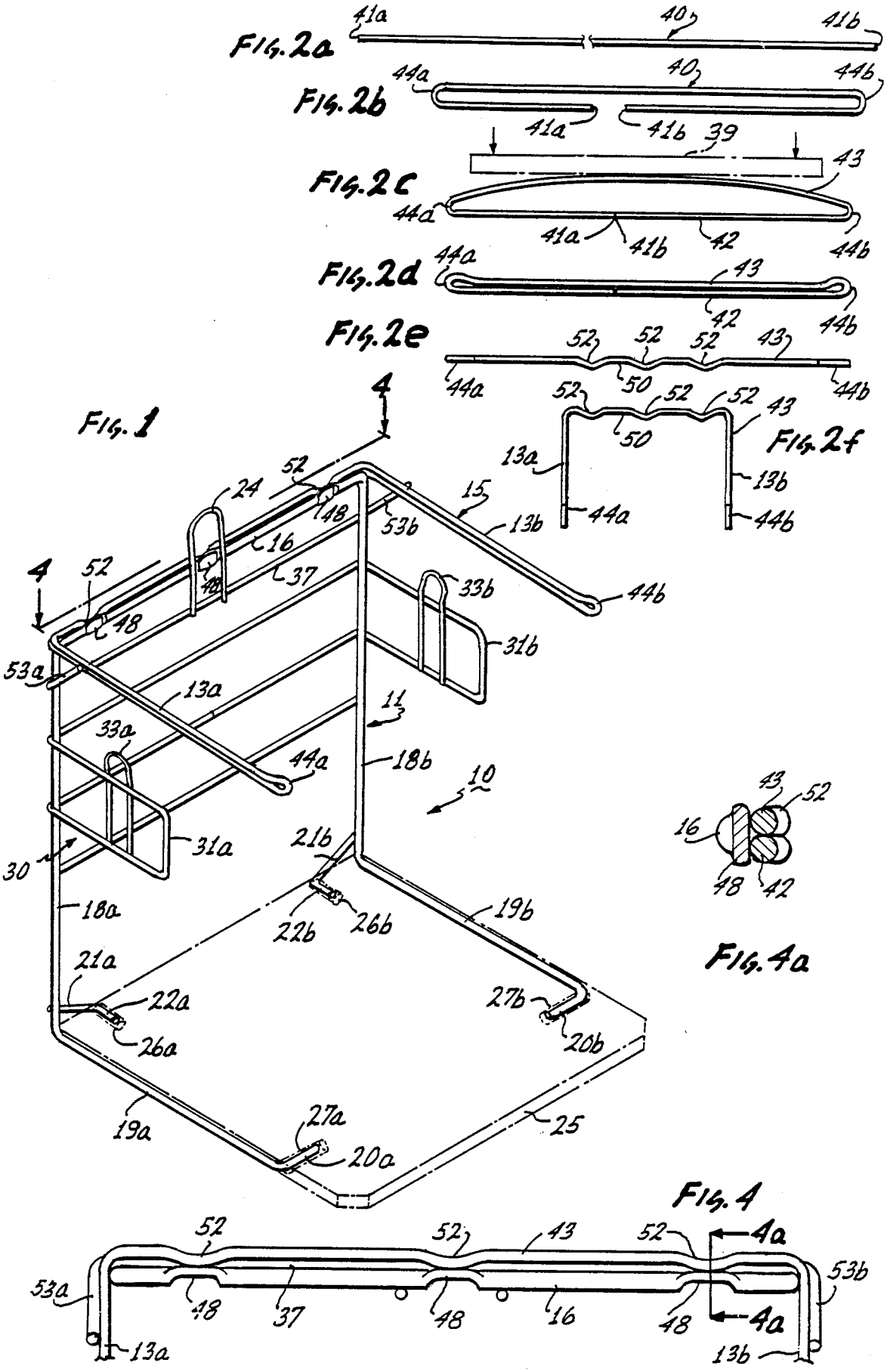
FIG. 1 is an overall perspective view of a free standing rack for plastic bags that incorporates the improved cantilevered support arms structure of the present invention.
FIGS. 2a–2f show the steps of forming the cantilevered support arms structure from a single length of wire.
FIG. 4 is a top view of the back end of the rack with the cantilevered support arms structure secured thereon as taken along lines 4—4 of FIG. 1.
FIG. 4a is a sectional view taken along line 4a—4a of FIG. 4.
Figure 3:
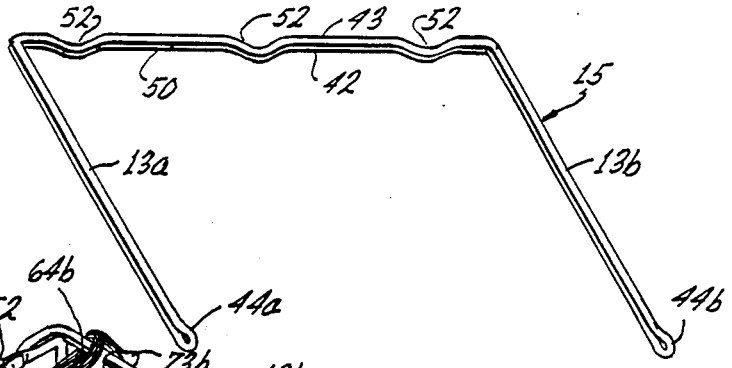
FIG. 3 is a perspective view of a completed cantilevered support arms structure of the present invention.

Reference will first be made to FIG. 1 which shows a perspective view of a typical free standing rack 10 for plastic bags provided with the cantilevered support arms structure 15 of the present invention. The rack 10, which, except for the cantilevered support arms structure 15, is well known in the art, includes a main frame 11 formed of a single length of 5/16 inch diameter wire. Thus, this single length of wire has its central portion bent to define a rectangular back comprised of a transverse top wire section 16 having at each end thereof downwardly extending vertical side sections 18a and 18b. Moreover, each of the vertical side wire sections 18a and 18b has at each of its bottom end forwardly extending horizontal bottom side wire sections 19a and 19b, the respective terminal ends of which are bent inwardly at right angles thereto to provide bottom side lugs 20a and 20b. In addition, short downwardly inclined back legs 21a and 21b have their upper ends secured near the bottom of the respective vertical side section wires 18a and 18b and have their lower ends bent inwardly at right angles thereto to provide bottom end lugs 22a and 22b extending parallel to and in the plane of the bottom side wire sections 19a and 19b. Such a structure enables a ½ inch thick rectangular polyethelene plate 25 (shown in phantom lines) to be used as a base for the rack 10. The plate 25 is provided on its rear end with end holes 26a and 26b located inwardly from the sides thereof and is provided on its respective side edges with side holes 27a and 27b located inwardly from the front end thereof. By resiliently pulling the outer ends of the bottom side wire sections 19a and 19b outwardly away from each other, the plate 25 can be positioned with the end holes 26a and 26b on its rear end inserted over the end lugs 22a and 22b on the back legs 21a and 21b. Then, upon releasing the bottom side wire sections 19a and 19b, they seat against the respective side edges of plate 25 with their side lugs 20a and 20b inserted in the side holes 27a and 27b on the side edges of the plate. In addition, a long, closed rectangular wire structure 30 has its end portions bent at right angles to the back central portion thereof to provide side wings 31a and 31b such that when structure 30 is secured to the upper middle portion of the vertical side wire sections 18a and 18b of the rectangular back of the rack, the wings 31a and 31b extend forwardly thereof. Hooks 33a and 33b are then secured on the respective wings 31a and 31b so as to project in a slightly outwardly direction from the top thereof. The hooks 33a and 33b are provided to enable small size plastic bags (not shown), generally similar to those shown in FIG. 5, to be carried thereon. Additionally, a transverse wire member 37 is connected across the vertical side wire sections 18a and 18b below the transverse top wire section 16 on the back of the rack. The end portions of the transverse wire member 37 are bent to provide upwardly inclined braces 53a and 53b which terminate at the level of the transverse top wire section 16. A hook 24 in the form of an inverted U-shaped member is secured by its legs across the center of the transverse top wire section and the transverse member 37, such that it projects above the transverse top wire section 16. Note also that the opposing vertical sides of the transverse top wire section 16 of the back of the rack are stamped pressed along their length at the center and inwardly from each of the ends thereof to provide rearwardly projecting vertically disposed flats 48 (See FIGS. 4 and 4a). These flats 48 are provided to enable the cantilevered arm supports structure 15 of the present invention to be attached to the back of the rack in a manner hereinafter to be described.

Next to be described is the manner of forming the improved cantilevered support arms structure 15 of the present invention. As shown in FIGS. 2a–2f, a straight length of 13/64 inch diameter wire 40 having opposite terminal ends 41a and 41b is used to form the structure 15. Initially, each of the respective end portions of the length of wire 40 is bent inwardly beneath its middle portion such that, as shown in FIG. 2b, the respective end portions lie spaced from but parallel to the middle portion and with their opposing terminal ends 41a and 41b spaced a short distance from each other. Note that each of the ends 44a and 44b of the bent structure formed at this time is U shaped, as shown. Next, the bottom terminal ends 41a and 41b in FIG. 2b are pulled together and butt welded to form, as shown in FIG. 2c, a closed two-wire structure including a straight lower portion 42 and an upwardly curved upper portion 43 which causes the U-shaped ends 44a and 44b of the two-wire structure to now open up more. Next, by use of a press brake die 39, which is positioned over the upwardly curved upper portion 43 with its ends located inwardly from each end of the two-wire structure, the upwardly curved upper portion 43 in FIG. 2c is pressed down such that, as shown in FIG. 2d, it is now parallel with and substantially in contact with the straight lower portion 42. Moreover, when so disposed, each of the ends 44a and 44b of the two-wire structure now formed has the shape of an upwardly directed looped protuberance thereon.

It should now be clearly understood that the reason for making the upper portion 43 of the wire initially upwardly curved, as shown in FIG. 2c, is to provide the excess material needed in the length of the upper portion 43 of the wire to provide the upwardly directed looped protuberances 44a and 44b at the ends of the two-wire structure when the upwardly curved upper portion 43 is swaged by die 39 to be parallel to and substantially in contact with the straight lower wire portion 42. The two-wire structure now provided, as shown in FIG. 2*d*, is next formed with three spaced forwardly projecting vertically disposed V-shaped offsets 52 along the middle portion 50 of the length thereof, as shown in FIG. 2*e*. The two-wire structure in FIG. 2*e* then has each of its end portions bent at a right angle from its middle portion 50, which defines the back of the two-wire structure, to form the cantilevered support arms 13*a* and 13*b* with the upwardly directed looped protuberances 44*a* and 44*b* located on the respective ends thereof. It should now be clear that the forwardly projecting spaced V-shaped offsets 52 on the back 50 of the two-wire structure are positioned so as to be located opposite the rearwardly projecting flats 48 provided on the back of the transverse top wire section 16 of the rectangular back of the rack 10, as previously described in connection with FIG. 1.

It should be noted that the cantilevered support arms structure 15 including its back wall 50 is comprised of a pair of 13/64 inch diameter wires while the frame 11 of the rack 10 including its transverse top wire section 16 is made of a single 5/16 inch diameter wire (FIG. 4*a*). Thus, it would be difficult to provide for spot welding the two smaller diameter wires forming the back 50 of the structure 15 directly to the single larger diameter wire forming the transverse top wire section 16 on the back of the rack because any pressure applied to the two smaller round wires of back 50 would cause them to slip and spread apart on the single larger round wire section 16.

Hence it should now be clearly understood that the reason the two wires forming the back 50 of the structure 15 are swaged so as to provide the forwardly projecting vertically disposed V-shaped offsets 52 at the center and inward from each end thereof, and the transverse top wire section 16 is swaged to provide similarly spaced rearwardly projecting vertically disposed flats 48 thereon, as shown in FIGS. 4 and 4*a*, is in order to enable the two-wire back 50 of the cantilevered support arms structure 15 to be spot welded on the back of the single transverse top wire section 16 forming the back of the rack, as shown in FIGS. 1, 4 and 4*a*.

To further help support the two-wire cantilevered support arms structure 15 on the back of the rack, as shown in FIG. 1, the upper ends of the upwardly inclined short braces 53*a* and 53*b* provided on the sides of the transverse wire member 37 on the back of the rack are welded to the upper and lower wires forming the respective cantilevered support arms 13*a* and 13*b* at a location close to the rear ends thereof. This provides for tying and holding together the upper and lower wires of each of the respective cantilevered support arms and thereby prevents either from being twisted by a load thereon such that its upper wire does not remain above its lower wire. Such a twisting would be undesirable because it would weaken the ability of the cantilevered support arms to resist bending since it no longer would have the truss affect afforded by having its two wires lying one above the other.

Figure 5:
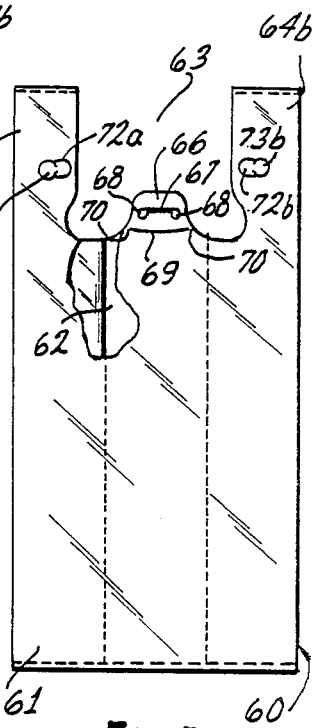
FIG. 5 is a front vertical view of a typical plastic bag shown in its flattened condition when a part of the stack.

Reference will next be made to FIG. 5 which shows a typical plastic bag 60 when in its flattened condition. The plastic bag is made from a short length of cylindrical plastic sheet material. Initially, each of the side portions of the cylindrical material is inwardly folded to form rectangular front and back walls 61 and 62 whose top and bottom edges are then secured together, as by heat. An upper central portion 63 of the rectangularly folded material is then cut out widely enough to include the edges of the inwardly folded portion on each side thereof to thereby provide vertically disposed generally rectangular handle portions 64*a* and 64*b* on each side thereof and an upwardly extending central tab 66 on each of the front and back walls thereof. Each tab 66 is provided with a horizontal slit 67 having small circular holes 68 at each end thereof. Each tab 66 also has an upwardly curved slit 69 on the bottom thereof which extends almost to the side edges thereof thereby leaving an intact area 70 of material at each end thereof. Also, generally horseshoe contoured holes 72*a* and 72*b*, having connecting flaps 73*a* and 73*b*, respectively, on the outer side edges thereof, are punched intermediate the length of each side handle portion 64*a* and 64*b* just inward from the inner edge thereof. These holes 72*a* and 72*b* are mounting holes used for suspending the plastic bags 60 by their side handle portions 64*a* and 64*b* on the cantilevered support arms 13*a* and 13*b*, respectively.

Figure 6:
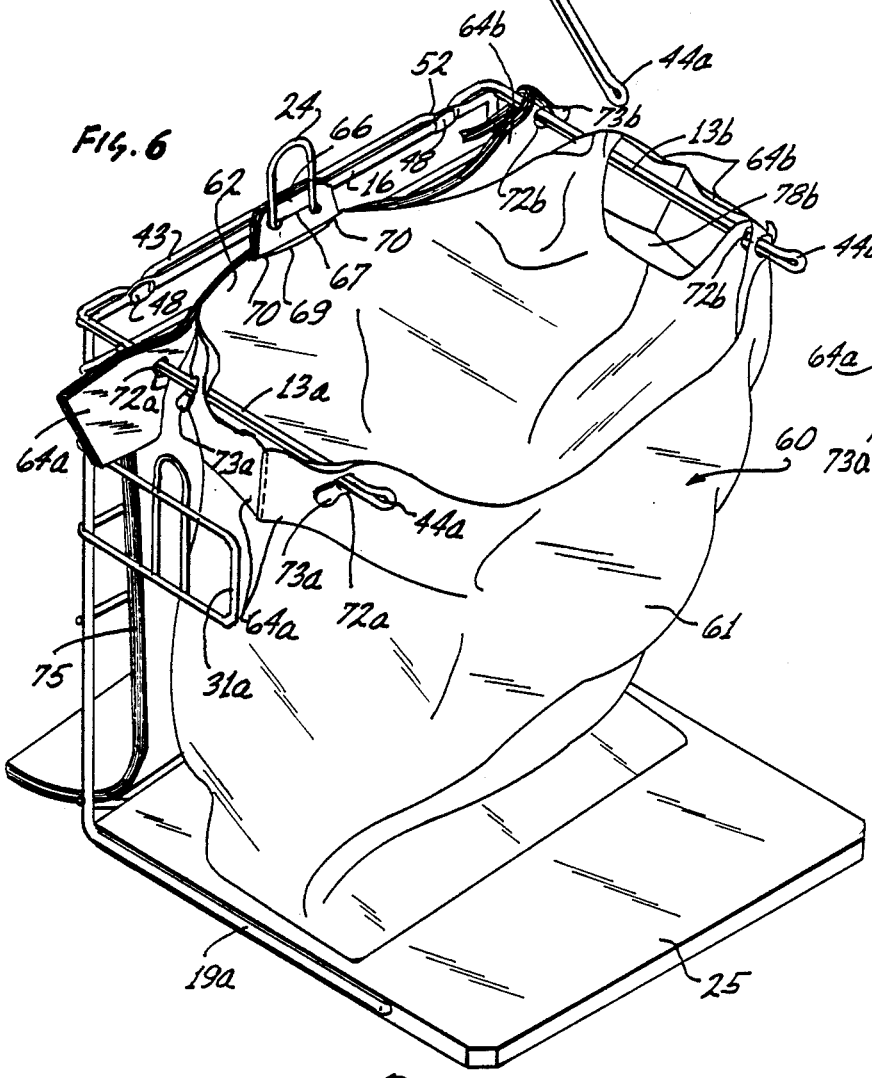
FIG. 6 is an overall perspective view of the rack as shown in FIG. 1 with a stack of plastic bags in a flattened condition being held thereon and showing the front bag of the stack opened up and held on the cantilevered support arms in an opened condition.

As shown in FIG. 6, a large number of such plastic bags 60, each folded flat, cut out and provided with mounting holes, as shown in FIG. 5, are positioned one over the other to form a stack 75 of such bags and their central tabs 66 are then secured together such that their horizontal slits 67 are aligned.

With the folded side handle portions 64*a* and 64*b* of the stack 75 of plastic bags 60 now having been moved down so as to extend horizontally outwardly in opposite directions, the punched mounting holes 72*a* and 72*b* on the folded side handle portions 64*a* and 64*b* are then fitted over the respective cantilevered support arms 13*a* and 13*b*. The stack 75 of the plastic bags is then slid along the support arms 13*a* and 13*b* toward the back of the rack where the horizontal slits 67 on the central tabs 66 are placed over the top of the hook 24 extending above the transverse top wire section 16 on the back of the rack. At this time, the lower bottom free end portions of the bags 60 in the stack 75 are then folded back so as to extend rearwardly of the bottom plate 25 of the rack, as shown. Now then, when it is desired to load a plastic bag 60 of the stack with groceries, a checker upon reaching over to grasp the exposed front wall 61 of the front plastic bag of the stack, tears the front wall 61 from the joined central tabs 66 of the stack 75 and causes the handle portions 64*a* and 64*b* on the front wall 61 to ride on their mounting holes 72*a* and 72*b* outwardly along the support arms 13*a* and 13*b*, respectively, thereby causing the body portion of the bag to open up, as shown in FIG. 6. Once the bag 60 has been loaded with groceries, the checker then lifts the loaded bag 60 by placing the fingers of her hands in the arm holes 78*a* and 78*b* of handle portions 64*a* and 64*b*, and, upon pulling the handle portions forwardly, causes the back wall 62 of the bag to be torn from the joined central tabs 66 of the stack and the bag to be removed from the cantilevered support arms 13*a* and 13*b*.

It should be noted in FIG. 6 that the looped protuberance 44*a* and 44*b* on the free end of the cantilevered support arms 13*a* and 13*b*, respectively, is upwardly directed, such that the end bulge formed by the loop is elevated above, and joined by a ramp, to the straight upper wire portion of the cantilevered support arm. Such a construction serves to prevent the side handle portions 64*a* and 64*b* on one front wall of an open plastic bag, being suspended on the cantilevered support arms by their mounting holes 72*a*, 72*b*, from slipping off the free ends of the cantilevered support arms while the plastic bag is being loaded with groceries.

Figure 7:
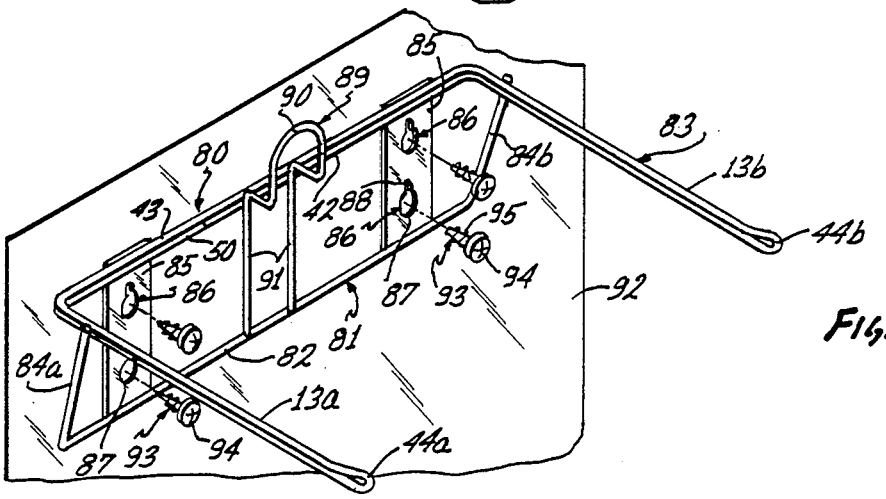
FIG. 7 shows another rack assembly that incorporates the cantilevered support arms structure of the present invention which makes use of a pair of strip connectors on the rear thereof for attachment of the rack assembly to a wall.

Another rack assembly 80 using the cantilevered support arms structure 81 of the present invention is shown in FIG. 7. The cantilevered support arms structure 83 is formed, as before described, except that the V-shaped offsets 52 on the back 50 of the structure 15 are not needed. In this rack assembly, a brace member 81 provided for the cantilevered support arms 13*a* and 13*b* includes a lower transverse wire back portion 82 that is spaced below the back 50 of the structure 83 and provided on the sides thereof with forwardly and upwardly inclined side arms 84*a* and 84*b* which have their upper ends welded to the two wires of the respective cantilevered support arms 13*a* and 13*b* near the rear ends thereof. A pair of connector plates 85 is provided on each side of the back of the rack assembly 80 for attaching the rack assembly 80 to a wall 92. Each of the connector plates 85 has its top end secured to the transverse back 50 of the structure 83 and its bottom end secured to the transverse wire back portion 82. Each connector plate 85 is provided with an opening 86 on the top and bottom halves thereof. Each opening 86 includes a circular hole 87 provided with a short slot 88 on the upper end thereof. In addition, an offset hook member 89 is secured by its legs 91 which extend across the center of the lower transverse wire back portion 82 and the back 50 of the structure 83. The legs 91 have on the top thereof forwardly extending offset portions joined by an upwardly curved wire 90 which provides a hook to hold a stack of bags (not shown) by horizontal slits provided on their joined central tabs. The pair of connector plates 85 provided on the back of the rack assembly 80 enables it to be mounted on a vertical wall 92, such as the side of a checkstand, for example. Having once determined the desired position of the back of rack assembly 80 on wall 92, the bodies 95 of screws 93 with enlarged heads 94 are fastened to the wall at points corresponding to the upper slots 88 of each of the openings 86. The connector plates 85 of the rack assembly 80 are then positioned with their circular holes 87 placed over the heads 94 of each of the screws such that each of the connector plates 85 is positioned behind the heads 94. The rack assembly 80 is then lowered such that the slots 88 above each of the circular holes 87 are now fitted over the bodies 95 and behind the heads 94 of the screws and the screws may be tightened, if necessary. This firmly holds the rack assembly 80 in position on the wall 92 while enabling the rack assembly 80 to be readily removed from the wall 92 if it is desired to relocate it to another checkstand. It should be appreciated that the rack assembly may be more permanently attached to a wall by merely providing small circular holes in the connector plates 85 and using screws with larger heads for securing the connector plates to the wall.

Although the description herein has been concerned with a particular embodiment of the present invention, it is to be understood that the invention is subject to various modifications in both the construction, arrangement and the method of making thereof. The invention, therefore, should be considered as including all possible variations and modifications coming within the scope and spirit of the invention as defined in the appended claims.

What is claimed is:

1. Apparatus for use in suspending flexible plastic bags on a rack, said apparatus comprising:

a wire back for said rack provided with side upper ends;

a transverse back wire member connected to the back of said rack so as to be positioned below the side upper ends thereof, said transverse back wire having on each side thereof a forwardly and upwardly inclined brace, each said brace provided with a terminal end;

a pair of elongated support arms, each support arm formed from a continuous length of wire bent back on itself so as to provide a free end portion with an upwardly directed looped protuberance thereon and upper and lower wire portions along the length thereof; and each said support arm connected to be cantilevered from one of the side upper ends of the back for the rack and further supported by having the upper and lower wire portions thereof connected near the rear thereof to the upper terminal end of the brace on each side of said transverse back wire member;

whereby the upwardly directed looped protuberances on the free end portions of said cantilevered support arms serve as safety features on the rack and the upper and lower wire portions provide the cantilevered support arms with a continuous surface.

2. Apparatus, formed of a single length of wire having a middle portion and end portions with terminal ends, for use in suspending plastic bags on a rack, said apparatus comprising:

a two-wire structure provided by bending each end portion of said single length of wire such that it lies on its middle portion with its opposing terminal ends secured together;

said two-wire structure having a middle portion and end portions with protuberances formed on each end thereof by the bending of each said end portion of said single length of wire on its middle portion; and said two-wire structure having each of its end portions bent at right angles to its middle portion to provide a support arm cantilevered forwardly from each end of the middle portion which forms the back of said two-wire structure;

whereby the protuberances on the ends of said cantilevered support arms serve as safety features and each of said cantilevered support arms is provided with a continuous surface throughout the length thereof.

3. Apparatus for use in suspending plastic bags on a rack as defined in claim 2 wherein the middle portion which forms the back of said two-wire structure is provided with space forwardly projecting vertically disposed V shaped offsets for use in attaching the two-wire structure to a wire back of the rack.

4. Apparatus, formed of a single length of wire having a middle portion and end portions with terminal ends, for use in suspending plastic bags on a rack, said apparatus comprising:

a structure comprised of upper and lower wire portions provided by bending each end portion of said single length of wire beneath its middle portion and having its terminal ends butt welded together;

said structure including a middle back portion and a support arm portion with a free end cantilevered forwardly from each end of said middle back portion;

said middle back portion having its upper wire portion lying above and substantially in contact with its lower wire portion throughout its length ; and each said cantilevered support arms having a protuberance on the free end thereof provided by the bending of the end portion of the single length of wire beneath its middle portion and having its upper wire portion substantially in contact with its lower wire portion throughout its length.

5. Apparatus, formed from a single length of wire having a middle portion and end portions with terminal ends, for use in suspending plastic bags on a rack, said apparatus comprising:

a double wire structure comprised of upper and lower wire portions provided by bending back each of the end portions of the single length of wire beneath its middle portion;

said double wire structure including a back portion and a support arm portion with a free end cantilevered forwardly from each end of said back portion;

each said cantilevered support arms having an upwardly directed looped protuberance on the free end thereof provided by the bending back of the end portion of the single length of wire beneath its middle portion and having its upper wire portion lying adjacent its lower wire portion throughout its cantilevered length; and said back portion having its upper wire portion lying adjacent its lower wire portion and having forwardly projecting vertically disposed V shaped offsets formed at the center of and inwardly from each end of the upper and lower wire portions thereof.

6. Apparatus for use in suspending plastic bags on a rack as defined in claim 5 wherein:

said rack has a back with a top transverse wire provided with rearwardly projecting vertically disposed flats at the middle and inward from each end thereof similarly to the spacing of the V shaped offsets on the back portion of the double wire structure;

each of the upper and lower wire portions forming the back portion of said middle wire structure has a diameter which is substantially 2/3 the diameter of the top transverse wire on the back of said rack; and the back portion of said double wire structure is secured to the back of said rack by spot welding the forwardly projecting V shaped offsets on the upper and lower wire portions forming the back portion of the double wire structure to the rearwardly projecting flats on the single wire forming the back of said rack.

7. Apparatus for use in suspending plastic bags on a rack, said apparatus comprising:

a double-wire structure formed from a single length of wire having a middle portion and end portions with terminal ends, said double-wire structure comprised of upper and lower wire portions provided by bending back each of the end portions of the single length of wire beneath its middle portion and having its terminal ends secured together;

said double-wire structure including a back portion and a support arm portion with a free end cantilevered forwardly from each end of said back portion;

each said cantilevered support arm portion having an upwardly directed looped protuberance on the front end thereof provided by the bending back of the end portion of the single length of wire beneath its middle portion and having its upper wire portion lying adjacent its lower wire portion throughout its cantilevered length; and a transverse back wire member having a forwardly and upwardly inclined brace with an upper terminal end on each side thereof;

said transverse back wire member located below the back portion of said double-wire structure to provide a back for said rack with the upper terminal ends of said braces secured to the upper and lower wire portions of the respective cantilevered support arms near the rear ends thereof; and a connector plate connected across the back portion and the transverse back wire member on each side of the back for said rack, each said connector plate provided with openings for enabling the back of said rack to be attached to a wall.

8. Apparatus, formed of a single length of wire having a middle portion and end portions with terminal ends, for use in suspending plastic bags on a rack, said apparatus comprising:

a structure comprised of upper and lower wire portions provided by bending each end portion of said single length of wire beneath its middle portion;

said structure including a middle back portion and a support arm portion with a free end cantilevered forwardly from each end of said middle back portion; and each said cantilevered support arm portion having a protuberance on the free end thereof provided by the bending of the end portion of the single length of wire beneath its middle portion and having its upper wire portion positioned adjacent its lower wire portion.

* * * * *